US008851332B2

(12) United States Patent
Mercer

(10) Patent No.: US 8,851,332 B2
(45) Date of Patent: Oct. 7, 2014

(54) ADHESIVE FILTRATION SYSTEM

(76) Inventor: Jeff L. Mercer, Hendersonville, TN (US)

( * ) Notice: Subject to any disclaimer, the term of this patent is extended or adjusted under 35 U.S.C. 154(b) by 0 days.

(21) Appl. No.: 13/475,858

(22) Filed: May 18, 2012

(65) Prior Publication Data

US 2013/0306679 A1 Nov. 21, 2013

(51) Int. Cl.
*B67D 7/76* (2010.01)

(52) U.S. Cl.
USPC ..... 222/189.06; 222/189.08; 222/146.2; 222/146.5; 222/504; 222/509; 222/1

(58) Field of Classification Search
USPC ..... 222/189.06, 189.08, 189.11, 146.2, 222/146.5, 630, 195, 394, 399, 1, 504, 509; 210/340, 348, 397, 414, 422, 767, 774, 210/175, 184.224, 231, 498, 499; 425/197–199
See application file for complete search history.

(56) References Cited

U.S. PATENT DOCUMENTS 3,815,788 A * 6/1974 Reighard et al. ..... 222/146.5
3,827,603 A * 8/1974 Reighard et al. ..... 222/146.5
3,942,687 A * 3/1976 Walus et al. ..... 222/146.5
3,964,645 A * 6/1976 Scholl ..... 222/146.5
4,159,953 A * 7/1979 Paquette ..... 210/396
4,446,017 A * 5/1984 Oberg ..... 210/90
4,717,472 A * 1/1988 Oberg ..... 210/90
4,850,425 A * 7/1989 Anderson ..... 165/65
5,975,312 A * 11/1999 Bonsan ..... 210/439
6,315,168 B1 * 11/2001 Bolyard et al. ..... 222/189.06
6,422,428 B1 * 7/2002 Allen et al. ..... 222/318
6,799,702 B1 10/2004 Mercer et al.
D536,421 S 2/2007 Raterman et al.
2005/0271806 A1 * 12/2005 Ganzer et al. ..... 427/207.1
2008/0190959 A1 * 8/2008 McGuffey et al. ..... 222/146.5
2008/0217360 A1 * 9/2008 MacLean et al. ..... 222/189.06

* cited by examiner

*Primary Examiner* — Frederick C Nicolas
*Assistant Examiner* — Bob Zadeh
(74) *Attorney, Agent, or Firm* — Shane V. Cortesi

(57) ABSTRACT

The present disclosure provides apparatuses for filtering hot adhesives. In certain embodiments, the present disclosure provides a filter plate that is used in conjunction with a heater and a valve assembly. In other embodiments, the present disclosure provides a filter screen that is located in a recess of the valve assembly housing, in addition to or in lieu of the use of a separate filter plate. Both embodiments utilize one or more ribs, which aid the flow of adhesive, facilitate the transfer of heat from the heater to the valve assembly, and optionally, physically support the filter screen.

27 Claims, 14 Drawing Sheets

ADHESIVE FILTRATION SYSTEM

FIELD OF INVENTION

The present invention generally relates to apparatuses for filtering hot adhesives, in particular, hot thermoplastic adhesives.

BACKGROUND OF INVENTION

Apparatuses for delivering hot thermoplastic adhesives, sometimes referred to as "hot melt adhesives", are known in the art. As shown in FIGS. 1 and 2, such apparatuses generally include a heater 12 to continue heating an adhesive and a valve assembly 14 directly attached to the heater 12. The heater 12 generally includes a housing 54 and a heater exit aperture 52 located in the housing for delivering the adhesive from the heater housing 54 to the valve assembly 14. The heater 12 may further include a clamp 49 for attaching the heater 12 to machinery. The heater 12 is connected to an external power source via a power cable 48. The valve assembly 14 generally includes a valve assembly housing 15, a valve assembly adhesive entrance aperture 24 for allowing the adhesive to enter the valve assembly housing 15, a valve assembly adhesive exit aperture or nozzle 20 for allowing the adhesive to exit the valve assembly housing 15, and a valve 17 having an open position in which the valve 17 permits the adhesive to exit the valve assembly housing 15 via the valve assembly adhesive exit aperture 20 and a closed position in which the valve 17 prevents the adhesive from exiting the valve assembly housing 15 via the valve assembly adhesive exit aperture 20. Adhesives may be heated externally then conveyed into the heater housing 54, where the heater 12 continues heating the adhesives. The adhesives then exit the housing 54 of the heater 12 through the heater adhesive exit aperture 52, enter the housing 15 of the valve assembly 14 through the valve assembly adhesive entrance aperture 24, and exit the valve assembly housing 15 through the valve assembly adhesive exit aperture 20. After the exiting the valve assembly adhesive exit aperture 20, the adhesive is ultimately applied to the target surface a number of different ways, including bead dispensing, non-contact spraying, and contact coating.

In some prior art adhesive systems, the valve 17 is opened and closed via electricity, as shown in FIG. 2. In other prior art adhesive systems, the valve 17 is opened via pressurized air, in which case the heater 12 delivers pressurized air to the valve assembly 14. In particular, air exits the housing 54 of the heater 12 through one or more heater to valve assembly air apertures 51, enters the valve assembly housing 15 through one or more valve assembly air apertures 23, and may exit the valve assembly housing 15 through a valve assembly air vent aperture 22, as shown in FIG. 1. In one such design, the system includes two heater to valve assembly air apertures 51 and two valve assembly air apertures 23, as shown in FIG. 1, in which case the valve 17 is both opened and closed via pressurized air. An opened air line may be used to open the valve 17 and a closed air line may be used to close the valve 17. The opened and closed air lines may be two way air lines with air pressure moving the valve stem or piston to the open position and the closed air line venting the air from the closed side of the piston, and the closed air line may be pressurized moving the valve stem or piston to the closed position with the opened air line venting the air from the opened side of the piston. In another design (not shown), the valve assembly 12 includes only one heater to valve assembly air aperture 51 and only one valve assembly air aperture 23, in which case the valve 17 may be opened via pressurized air and closed via a spring. A set screw 22A may be available to set the valve stem or piston travel length.

A problem with the systems described above is that particulate matter in the adhesives can clog the valve assembly adhesive exit aperture or nozzle 20 and/or valve 17 over time, leading to the inoperability of the valve assembly adhesive exit aperture or nozzle 20 and/or valve 17. This problem is significant, given that many valves, such as those produced by Nordson Corp., are located in hard to reach places in the valve assembly housing 15. Ultimately, many users decide to replace the entire valve assembly at a cost of approximately $100 to $1,000.

As illustrated in FIGS. 1 and 2, and described in, for example, U.S. Pat. Nos. 6,799,702 and 6,315,168, an internal filter 68 disposed within the valve assembly housing 15 has been previously described. However, by disposing the filter 68 within the valve assembly housing 15, the filter 68 cannot be replaced without disassembling the valve assembly housing 15.

U.S. Patent Publication No. 2008/0217360 discloses a filter screen that is located in a recess in the housing of the valve assembly so that an adhesive is delivered from the heater adhesive exit aperture 52 through the filter screen and into the valve assembly adhesive entrance aperture 24. However, a potential problem with the system of U.S. Patent Publication No. 2008/0217360 is that contaminants stop the flow of adhesive when the limited area of the valve assembly adhesive entrance aperture 24 becomes covered and clogged as the adhesive flows from the heater adhesive exit aperture 52 through the small filter screen and into the small valve assembly adhesive entrance aperture 24, which could occur in a short period of time.

Therefore, there is a continuing need for new and better apparatuses for filtering hot adhesives.

SUMMARY

The present disclosure provides apparatuses for filtering hot adhesives. In some embodiments, the present disclosure provides a filter plate for filtering an adhesive that includes: a) a proximal surface configured to face a heater; b) a distal surface configured to face a valve assembly; c) a filter plate adhesive recess located in the proximal surface; d) a filter plate adhesive exit aperture located in the recess and extending through the distal surface; and e) one or more ribs located in the recess, the ribs each having a rib base attached to a wall of the filter plate forming the recess and a rib apex extending proximally from the base. In use, a filter screen is located in the recess and the filter plate is positioned between a heater, which includes a heater housing and an adhesive exit aperture located in the housing allowing for flow of an adhesive, and a valve assembly, which includes a valve assembly housing, a valve assembly adhesive entrance aperture for allowing the adhesive to enter the valve assembly housing, a valve assembly adhesive exit aperture for allowing the adhesive to exit the valve assembly housing, and a valve having an open position in which the valve permits the adhesive to exit the valve assembly housing via the valve assembly adhesive exit aperture and a closed position in which the valve prevents the adhesive from exiting the valve assembly housing via the valve assembly adhesive exit aperture. Optionally, the filter screen is proximally disposed relative to the ribs and contacts the apexes of the ribs. The filter plate has a filter plate thickness extending from the proximal surface to the distal surface and optionally the filter plate thickness is from about 3 millimeters to about 7 millimeters. Optionally, two or more filter plates with filter screens having different sized apertures are disposed between the valve assembly and the heater for staged filtration. Optionally, the ribs or ribs assembly may be removable or a press fit configuration.

In certain embodiments, the filter plate, heater and valve assembly are used in a method for filtering an adhesive that includes:

a) providing the filter plate, valve assembly and heater;

b) heating the adhesive in the heater housing;

c) opening the valve; and d) delivering the adhesive from the heater adhesive exit aperture, through the filter screen, through the filter plate adhesive exit aperture, through the valve assembly adhesive entrance aperture, into the valve assembly housing and out of the valve assembly adhesive exit aperture. Optionally, the temperature of the adhesive drops not more than about 10° F. as the adhesive flows from the heater adhesive exit aperture to the valve assembly adhesive exit aperture.

In an alternative embodiment, in addition to or in lieu of a separate filter plate, the ribs and filter screen are located in a recess of the valve assembly housing.

Without being bound by any particular theory, it is believed that, whether the ribs are provided in the recess of the valve assembly housing and/or in the recess of the filter plate, the ribs aid and direct the flow of adhesive, facilitate the transfer of heat from the heater to the valve assembly, and optionally, physically support the filter screen.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

Figure 1:
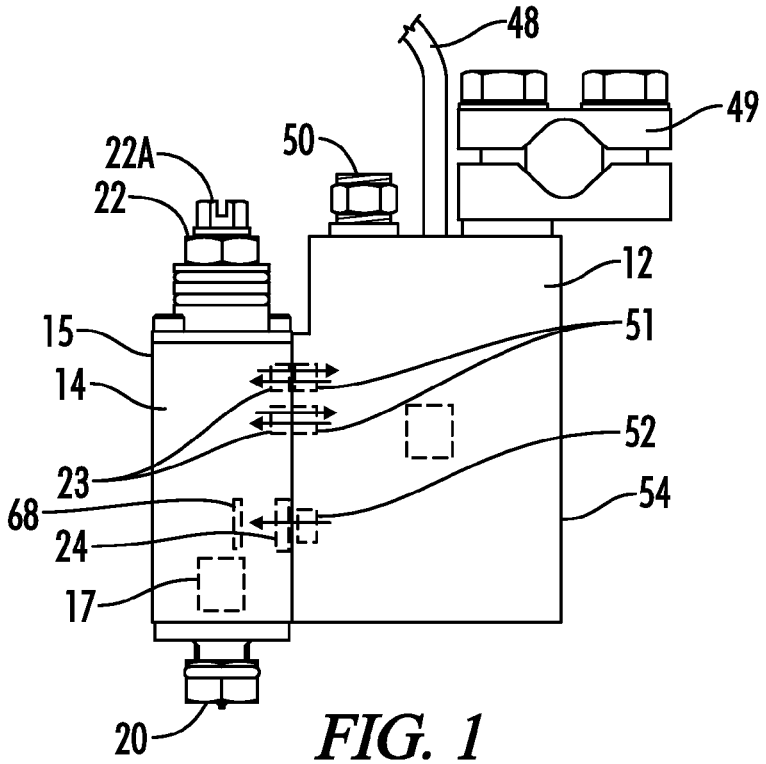
FIG. 1 (PRIOR ART)
FIG. 1 is a side view of a prior art heater and an air-operated valve assembly.
Figure 2:
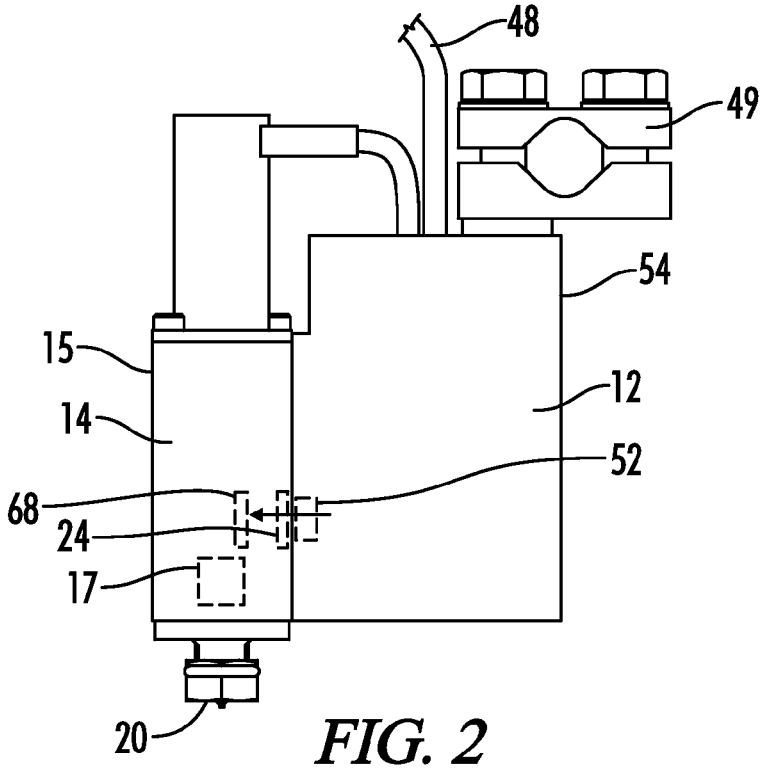
FIG. 2 (PRIOR ART)
FIG. 2 is a side view of a prior art heater and an electric valve assembly.

Referring now to the drawings, FIGS. 3-32 illustrate components of an adhesive filtration system generally designated by the numeral 11. In the drawings, not all reference numbers are included in each drawing for the sake of clarity. In addition, positional terms such as "horizontal," "vertical," "upper," "lower," "side," "top," "bottom," etc. refer to the apparatus when in the orientation shown in the drawing. The skilled artisan will recognize that the apparatus can assume different orientations when in use.

Figure 3:
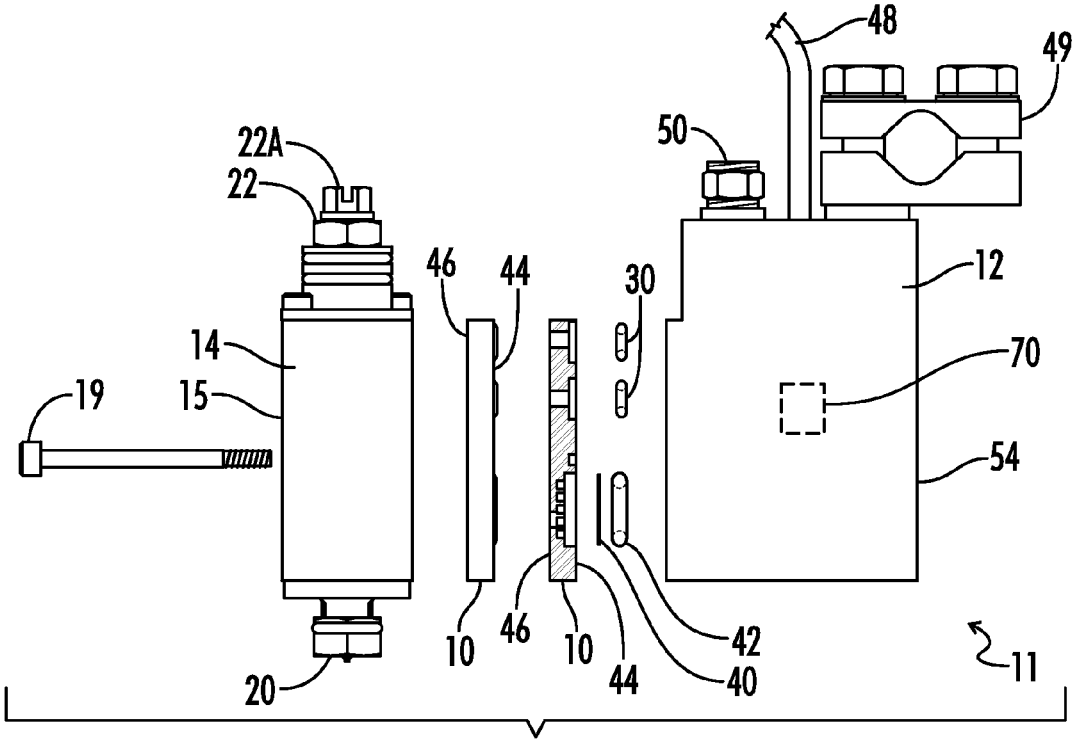
FIG. 3 is a side view showing the assembly of an adhesive filtration system of one embodiment of the present invention, wherein a sectional view of the proximal filter plate is provided.
Figure 4:
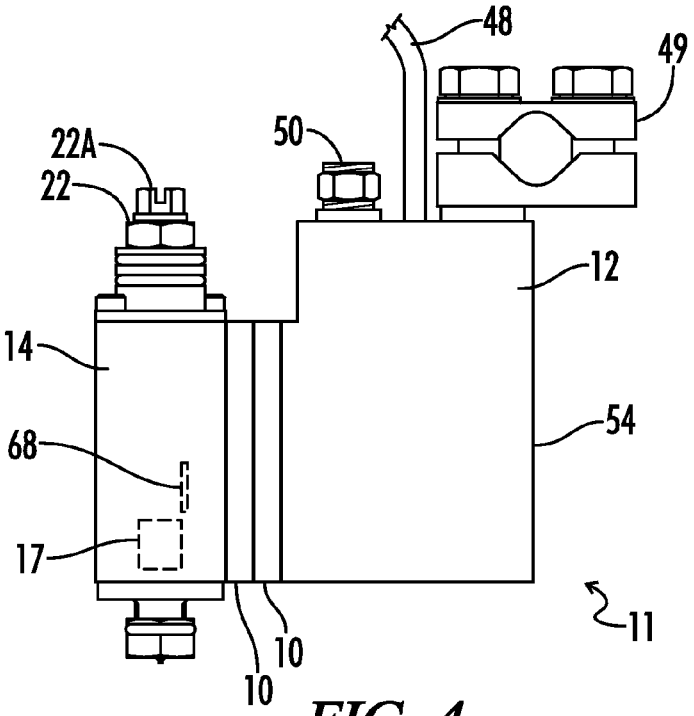
FIG. 4 is a side view showing an assembled adhesive filtration system of one embodiment of the present invention.
Figure 5:
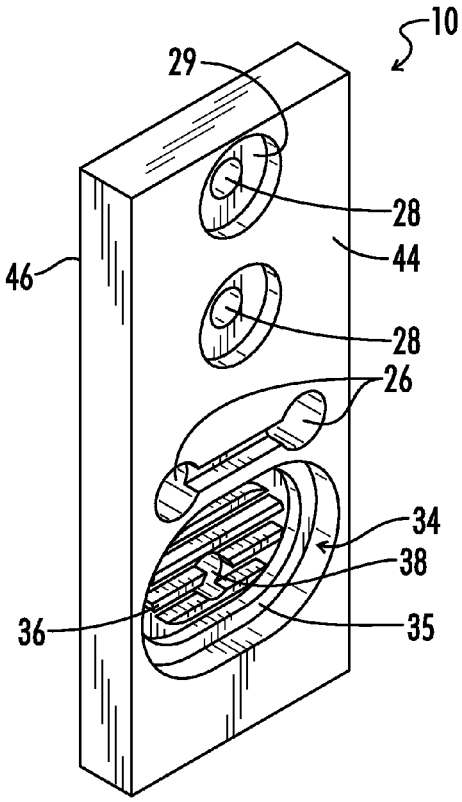
FIG. 5 is a proximal, perspective view of a filter plate of one embodiment of the present invention.

Referring further to FIGS. 3-32, the system 11 includes a heater 12, a valve assembly 14 and a filter plate 10. The heater 12 includes a housing 54, a thermoplastic adhesive disposed within the heater housing 54, a heating element 70 to heat the heater 12, and a power supply coupled to the heating element 70 for powering the heating element 70. Preferably, the heating element 70 is configured to heat the adhesive to a temperature of at least 250° F., e.g., a temperature of from about 250° F. to about 450° F. The power supply is located outside the housing 54 and the heating element 70 is coupled to the external power supply via a cable 48, as shown in FIGS. 3 and 4. The heater 12 further includes a heater exit adhesive exit aperture 52 for dispensing an adhesive. Optionally, the heater 12 further includes two or more threaded fastener apertures 16 for securing the filter plate 10 between the valve assembly 14 and the heater 12 via a fastener 19. Optionally, the heater 12 includes a clamp 49 for securing the heater 12 to machinery. Optionally, if the heater 12 is used in conjunction with a valve assembly 14 that is operated by air, the heater 12 includes an external air aperture 50 and one or more heater to valve assembly air apertures 51. Heaters 12, also referred to as heated manifolds or blocks, 12 are well-known to those of ordinary skill and are commercially available from companies such as Illinois Tool Works (ITW), Glenview, Ill.

Figure 7:
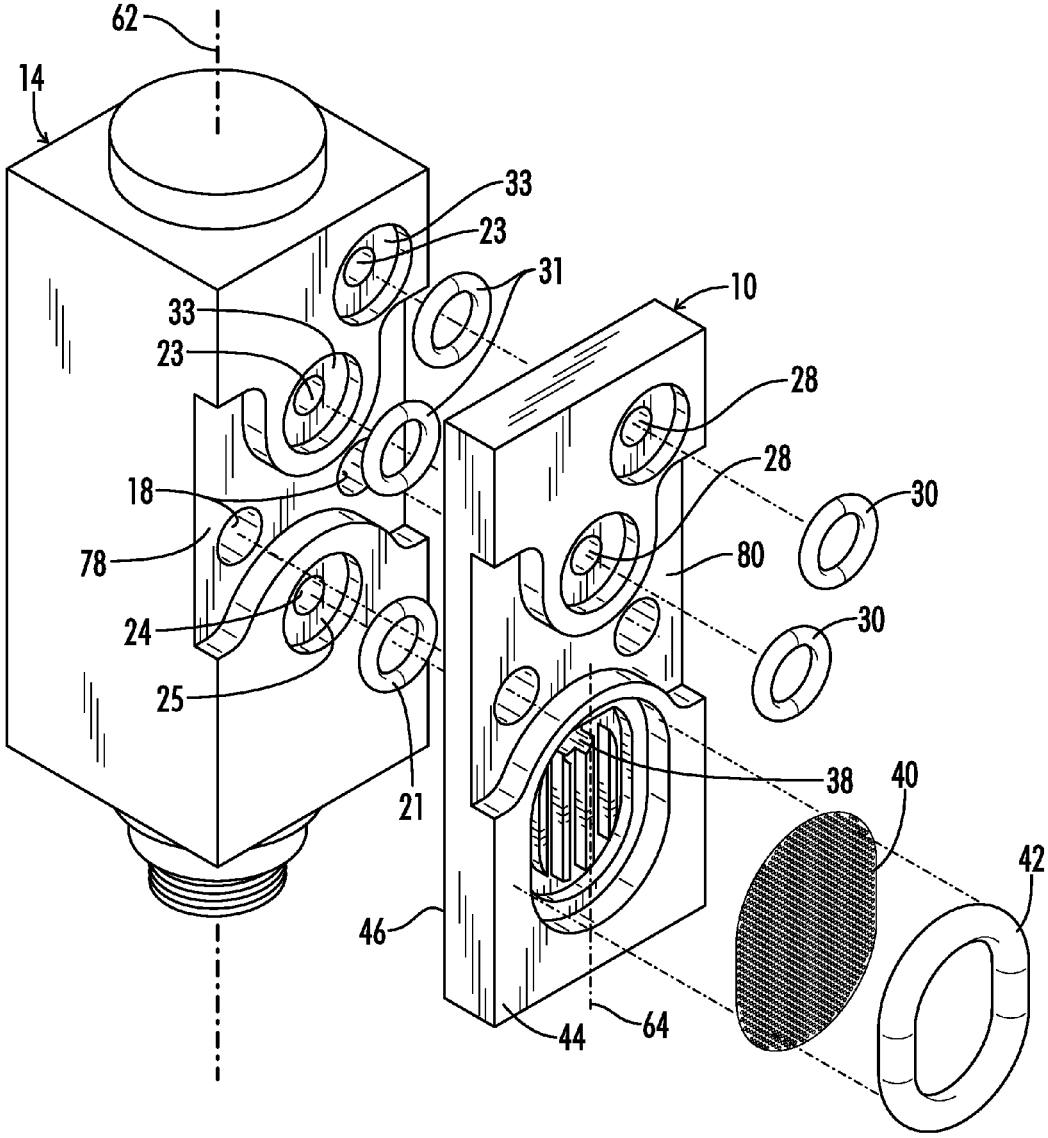
FIG. 7 is a proximal, perspective view of a filter plate and valve assembly of one embodiment of the present invention.

The system further includes a valve assembly 14. The valve assembly 14 includes a valve assembly housing 15, a valve assembly adhesive entrance aperture 24 for allowing the adhesive to enter the valve assembly housing 15, a valve assembly adhesive exit aperture or nozzle 20 for allowing the adhesive to exit the valve assembly housing 15 and a valve 17. The valve 17 has an open position in which the valve 17 permits the adhesive to exit the valve assembly housing 15 via the valve assembly adhesive exit aperture 20 and a closed position in which the valve 17 prevents the adhesive from exiting the valve assembly housing 15 via the valve assembly adhesive exit aperture 20. Optionally, the valve assembly 14 includes a valve assembly air vent aperture 22. Optionally, the valve assembly 14 includes a valve stem or piston and a set screw 22A is used to set the valve stem or piston travel length. In certain embodiments, the valve 17 is moved from the open to the closed position via electricity. For valves 17 that are operated by electricity, the electric valve assembly 14 may be directly connected to the power supply or the electric valve assembly 14 may be coupled to the heater 12, which, in turn, is directly connected to the power supply. In other embodiments, the valve 17 is opened via pressurized air. In one such embodiment, the valve 17 is opened via air and closed via a spring, in which case the valve assembly 14 typically includes one valve assembly air aperture 23. In another embodiment, the valve 17 is both opened and closed via air. An opened air line may be used to open the valve 17 and a closed air line may be used to close the valve 17. The opened and closed air lines may be two way with air pressure moving the valve stem or piston to the open position and the closed air line venting the air from the closed side of the piston, and the closed air line may be pressurized moving the valve stem or piston to the closed position with the opened air line venting the air from the opened side of the piston. It will be understood that the operation of the valve assembly 14 described above is merely exemplary and the systems 11 of the present disclosure may be used with any valve assembly 14 that is suitable for use in conjunction with heated thermoplastic adhesives. Optionally, the valve assembly housing 15 has a large cut-out 78, as shown in FIG. 7. Valve assemblies used with heated thermoplastic adhesives and methods of opening valves 17 via, for example, pistons and solenoids, are described in, for example, U.S. Pat. Nos. 6,315,168, 5,672,269 and 6,799,702, the contents of each of which are incorporated by reference herein in their entirety. Optionally, the valve assembly 14 further includes an interior filter 68 disposed in the housing 15 as described in, for example, U.S. Pat. Nos. 6,315,168 and 6,799,702. Preferably, the valve assembly 14 is configured to transport thermoplastic adhesives having a temperature of at least 250° F. Optionally, the valve assembly air aperture 23 and the valve assembly adhesive entrance aperture 24 are located in recesses 33 and 25 in the valve assembly housing 14, as exemplified in FIGS. 7, and O-rings 31 and 21 are positioned in the recesses 33 and 25, when the system 11 is in use. Optionally, the valve assembly 14 further includes two or more fastener apertures 18 for securing the valve assembly 14 and the filter plate 10 with the heater 12. Optionally, the adhesive exit aperture 20 is disposed at about a 90 degree angle with respect to the adhesive entrance aperture 24, as illustrated in FIGS. 3, 4 and 7.

Figure 26:
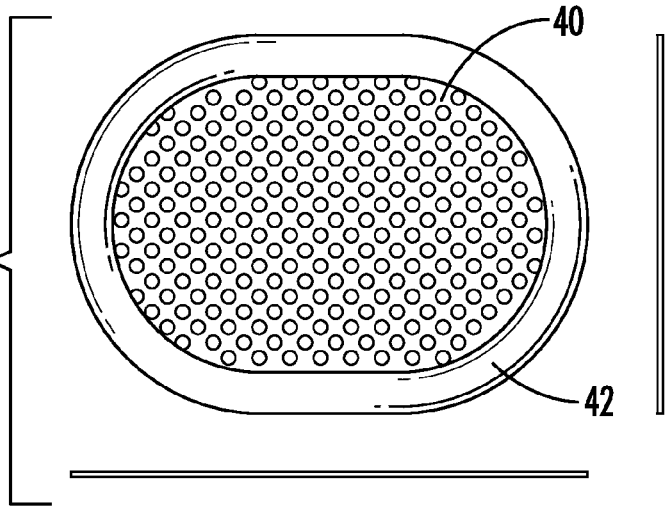
FIG. 26 illustrates a proximal view of a filter screen and an O-ring of one embodiment of the present invention.
Figure 27:
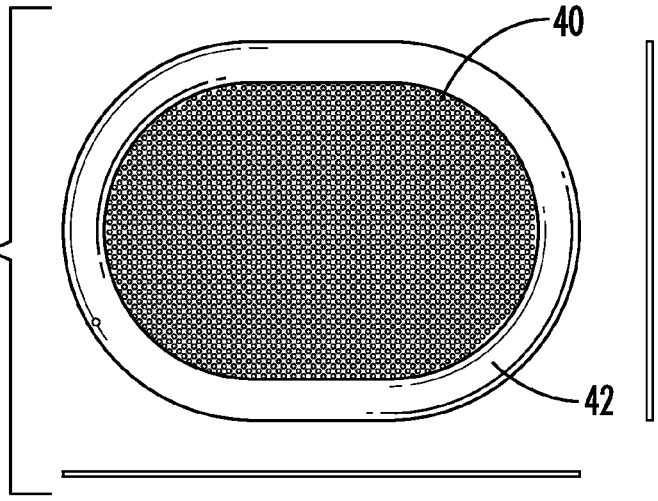
FIG. 27 illustrates a proximal view of a filter screen and an O-ring of one embodiment of the present invention.
Figure 28:
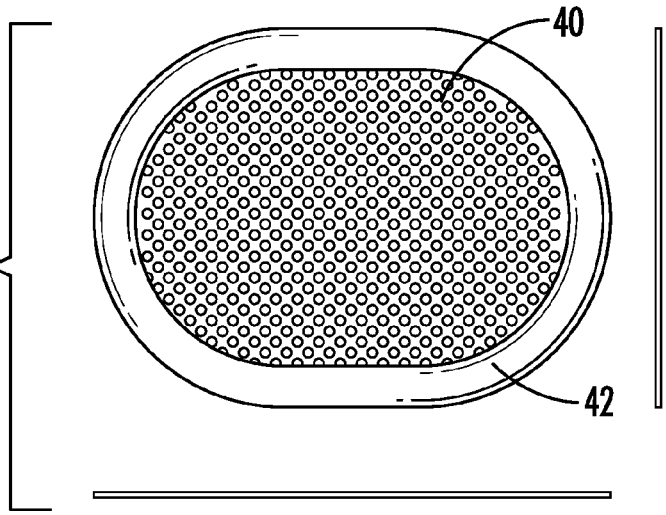
FIG. 28 illustrates a proximal view of a filter screen and an O-ring of one embodiment of the present invention.
Figure 29:
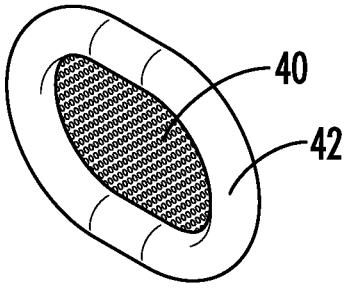
FIG. 29 illustrates a proximal, perspective view of a filter screen and an O-ring of one embodiment of the present invention.
Figure 30:
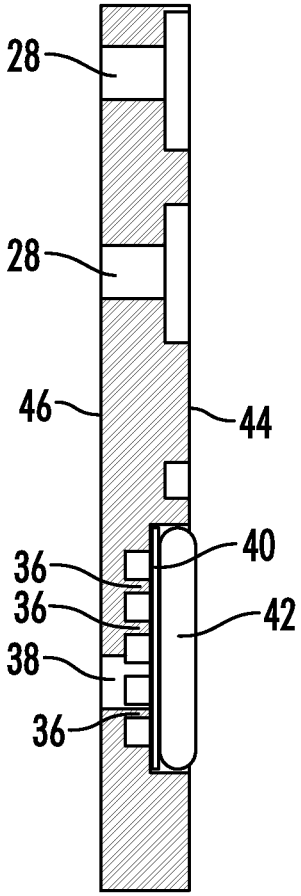
FIG. 30 illustrates a side, cross-sectional view of a filter plate of one embodiment of the present invention.
Figure 31:
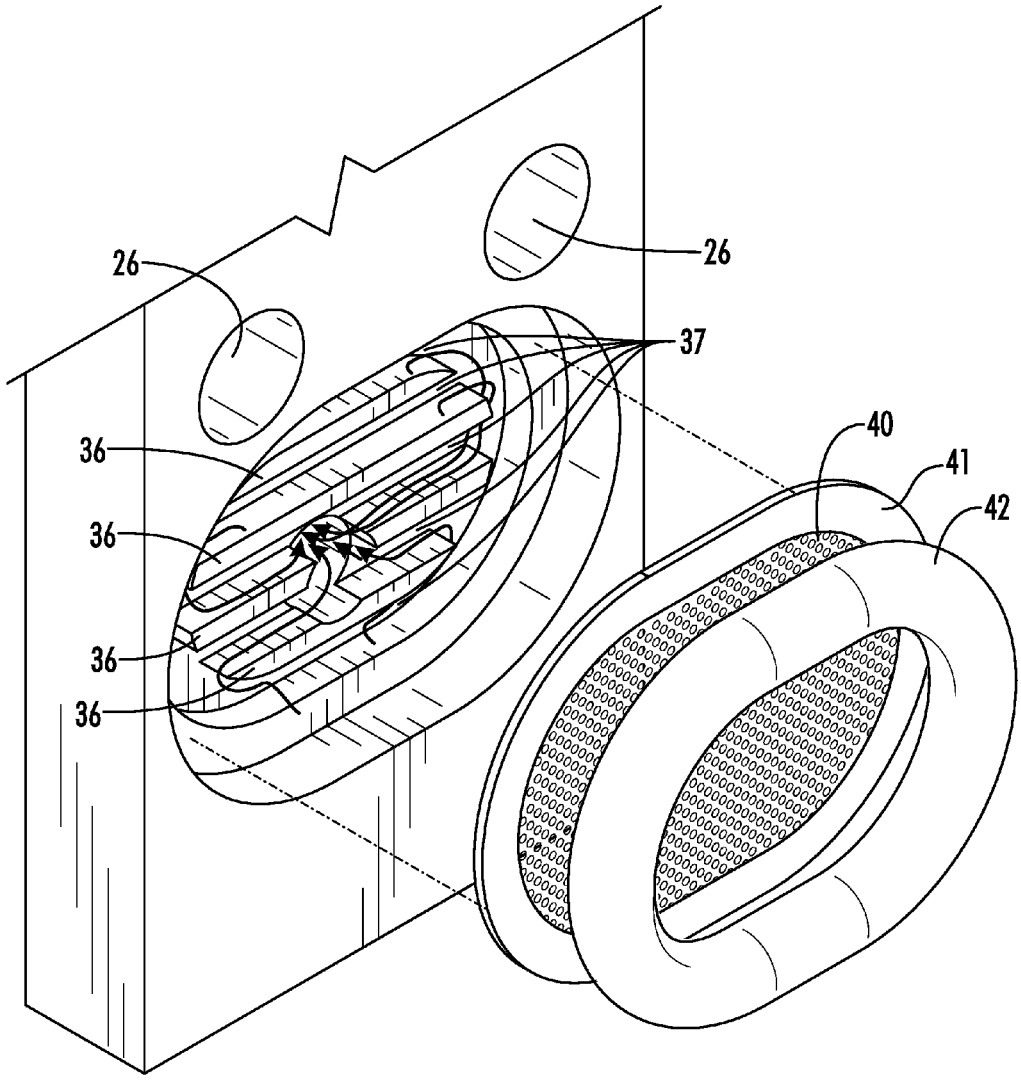
FIG. 31 illustrates an exploded proximal, perspective view of a filter plate of one embodiment of the present invention; arrows illustrate the flow of an adhesive through a grid created by the ribs.
Figure 32:
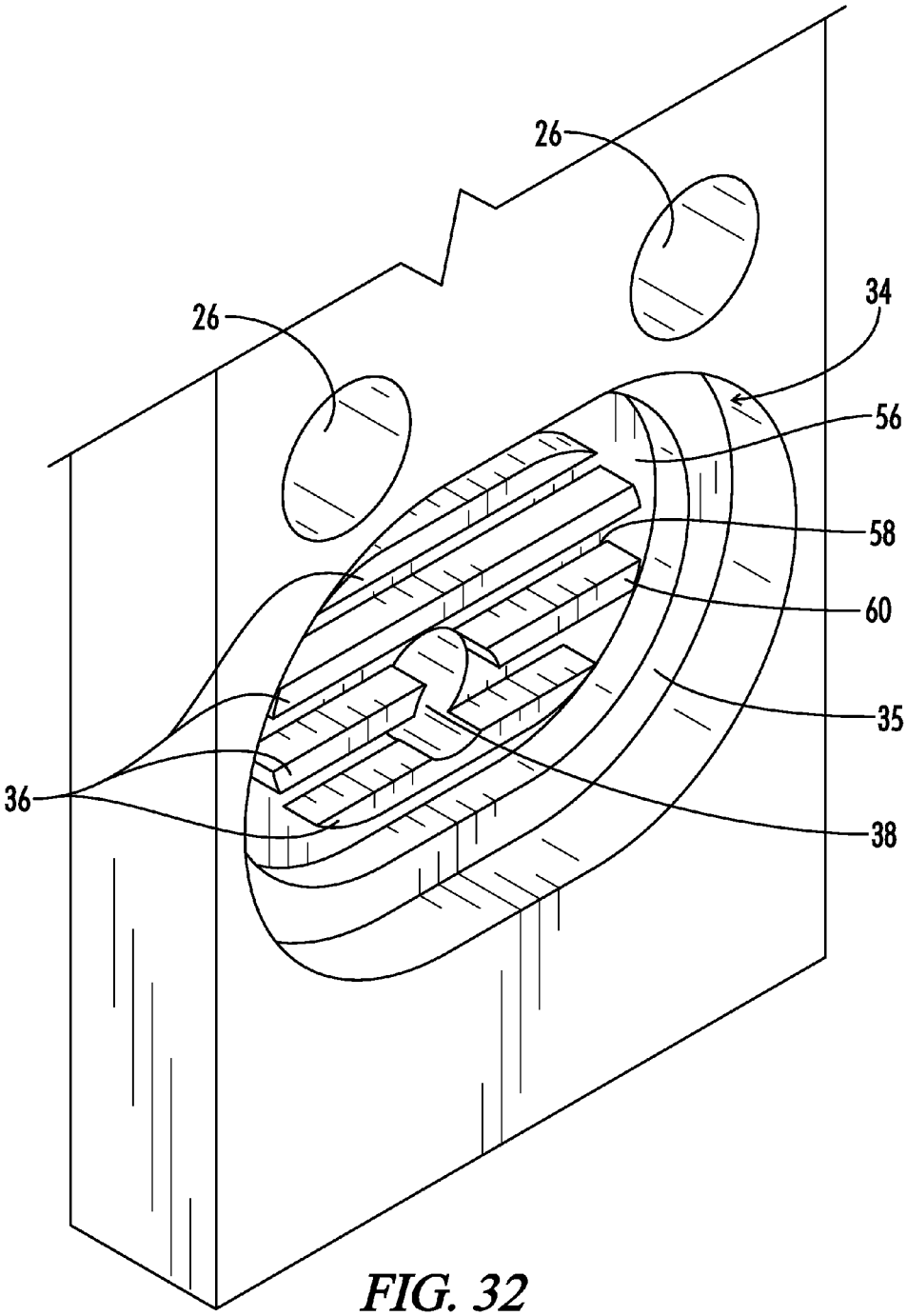
FIG. 32 illustrates an exploded proximal, perspective view of a filter plate of one embodiment of the present invention.

The system 11 further includes one or more filter plates 10 positioned between the heater 12 and the valve assembly 14. The filter plate 10 has a proximal surface 44 configured to face the heater housing 54 and a distal surface 46 configured to face the valve assembly housing 15. The filter plate proximal surface 44 includes an adhesive recess 34. A filter plate adhesive exit aperture 38 is located in a wall 56 of the filter plate 10 forming the adhesive recess 34 (e.g., the distal-most wall of the adhesive recess 34, as best seen in FIG. 32) and extends through the distal surface 46. The filter plate 10 further includes one or more filter plate ribs 36. Alternatively, the ribs 36 may be removable. Each rib includes a rib base 58, which may be attached to a wall 56 of the filter plate 10 forming the adhesive recess 34 (e.g., the distal-most wall of the adhesive recess 34, as best seen in FIG. 32) and a rib apex 60, which extends proximally from the rib base 58. Preferably, the apexes 60 of the ribs are flat, as illustrated in FIGS. 5, 7, 31 and 32). Alternatively, the apexes 60 may be rounded. The filter plate 10 further includes a filter screen 40 located in the recess 34. The filter screen 40 may be, for example, a wire screen. Preferably, the filter screen 40 is comprised of aluminum, stainless steel and/or a metal alloy. Illustrative designs of the filter screen 40 are shown in FIGS. 26-28. It will be appreciated that the patterns shown in FIGS. 26-28 are merely exemplary and other patterns may be utilized in conjunction with the present disclosure.

Preferably, the filter screen 40 is disposed proximally relative to the ribs 36 and the apexes 60 of the ribs 36 contact and support the filter screen 40. Preferably, the filter screen 40 is removable so the filter screen 40 can be cleaned or replaced with a different filter screen 40, depending on the needs of the person operating the system 11. Optionally, the filter plate 10 further includes two or more fastener apertures 26 for securing the filter plate 10 between the valve assembly 14 and the heater 12. Further, if the valve 17 is opened by air, preferably, the filter plate 10 includes one or more air apertures 28 so that air may be delivered from the heater to valve assembly air aperture(s) 51 through the filter plate air aperture(s) 28 and into the valve assembly air aperture(s) 23. Optionally, the filter plate 10 further includes a filter plate air aperture recess 29 located in the proximal surface 44 and an O-ring 30 is placed in the filter plate air aperture recess 29 so that the filter plate 10 creates a seal when the proximal surface 44 is placed against either the heater housing 54 or the distal surface 56 of another filter plate 10. Optionally, the filter screen 40 is secured to the filter plate 10 by an O-ring 42. In such embodiments, the O-ring 42 may be integral with the filter screen 40 or may rest on a border 41 surrounding the filter screen 40 when the filter screen 40 is placed in the adhesive recess 34. Preferably, the O-ring 42 completely covers the border 41 so the adhesive is guided through the filter screen 40. The O-ring 42 preferably forms four purposes: 1) attaching and sealing the filter screen 40 to the adhesive recess 34; 2) facilitating the flow of the adhesive through the filter screen 40; 3) providing as large a reservoir as possible where debris may accumulate without hindering the flow of the adhesive; and 4) sealing the adhesive exit aperture 52 of the heater 12 or additional stackable filter plates. Preferably, the O-ring 42 rests on the filter screen 40, which rests on a ledge 35 of the filter plate, and the ledge 35 is heated by the adhesive and heat is transferred through the filter plate 10. The ribs 36 preferably perform three purposes: 1) physically supporting the filter screen 40; 2) creating a grid 37 that helps direct the flow of the adhesive into the adhesive exit aperture 38 (as best seen in FIGS. 31); and 3) increasing the surface area of the filter plate 10 that the adhesive contacts so as to minimize heat loss as the adhesive moves from the heater adhesive exit aperture 52 and into the valve assembly adhesive entrance aperture 24.

Figure 8:
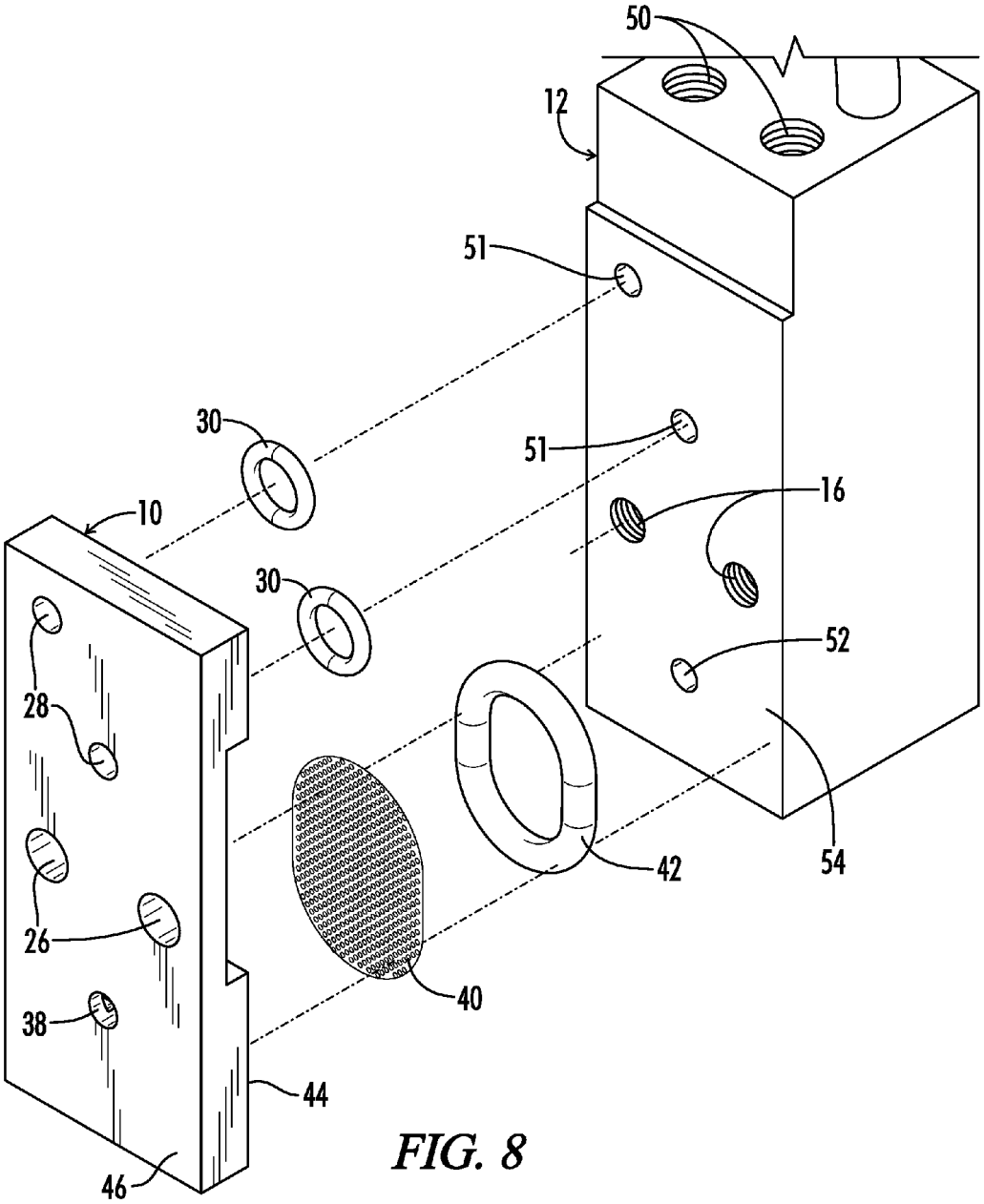
FIG. 8 is a distal, perspective view of a filter plate and heater of one embodiment of the present invention.
Figure 9:
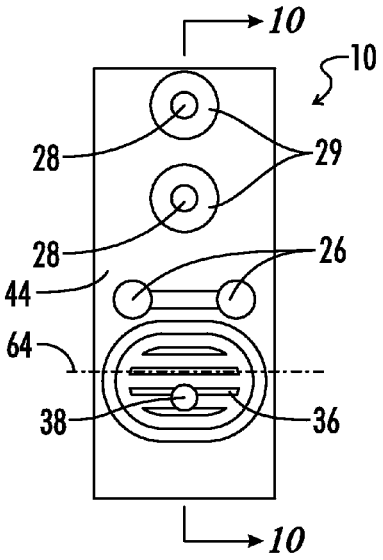
FIG. 9 is a proximal view of a filter plate of one embodiment of the present invention.
Figure 10:
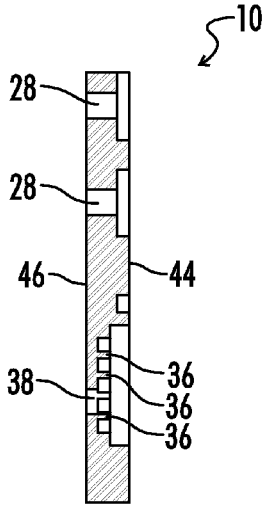
FIG. 10 is a sectional view of the filter plate of FIG. 9, taken along line 10-10 of FIG. 9.
Figure 11:
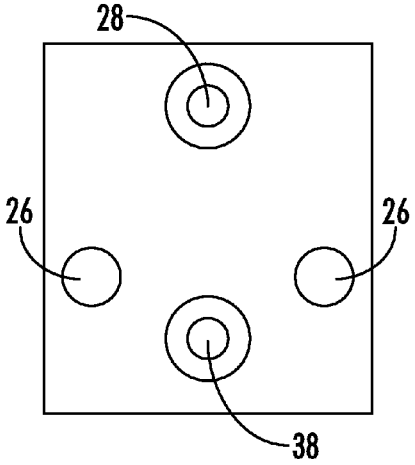
FIG. 11 is a distal view of a filter plate of one embodiment of the present invention.
Figure 12:
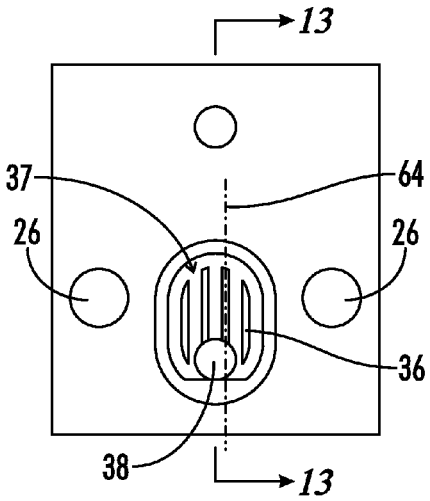
FIG. 12 is a proximal view of the filter plate of FIG. 11.
Figure 13:
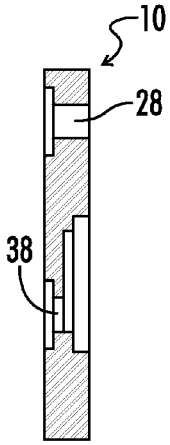
FIG. 13 is a sectional view of the filter plate of FIG. 12, taken along line 13-13 of FIG. 12.
Figure 14:
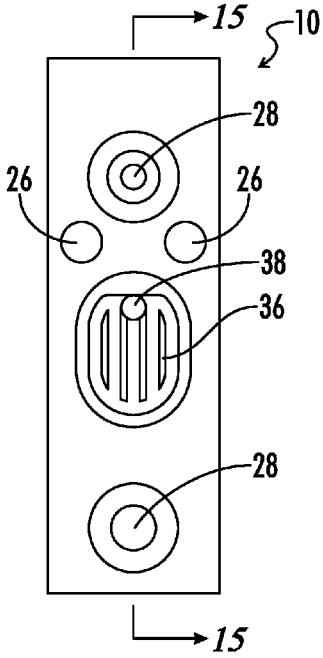
FIG. 14 is a proximal view of a filter plate of one embodiment of the present invention.
Figure 15:
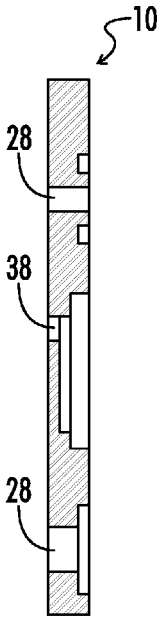
FIG. 15 is a sectional view of the filter plate of FIG. 14, taken along line 15-15 of FIG. 14.
Figure 16:
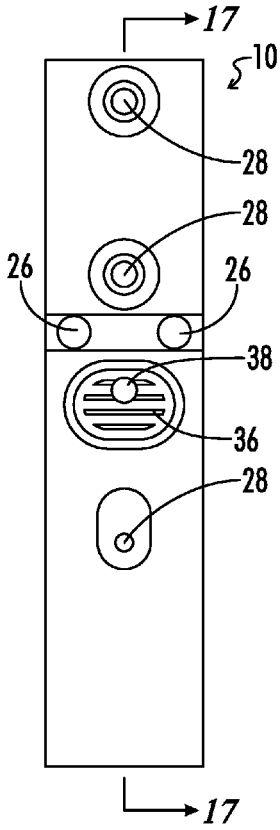
FIG. 16 is a proximal view of a filter plate of one embodiment of the present invention.
Figure 17:
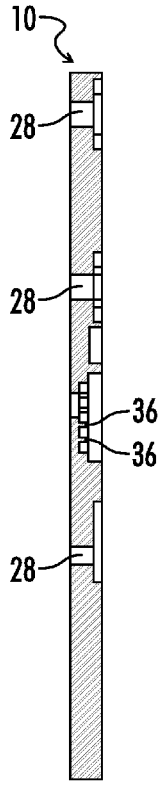
FIG. 17 is a sectional view of the filter plate of FIG. 16, taken along line 17-17 of FIG. 16.
Figure 18:
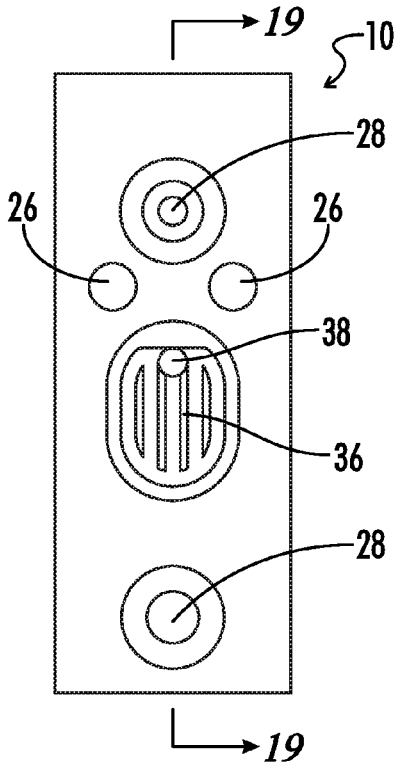
FIG. 18 is a proximal view of a filter plate of one embodiment of the present invention.
Figure 19:
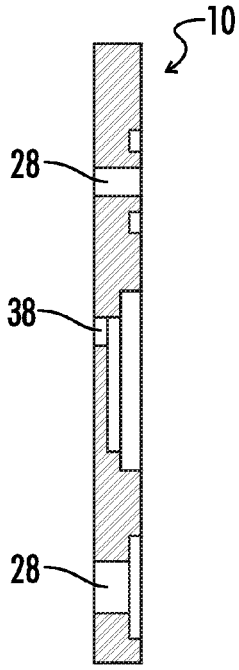
FIG. 19 is a sectional view of the filter plate of FIG. 18, taken along line 19-19 of FIG. 18.
Figure 20:
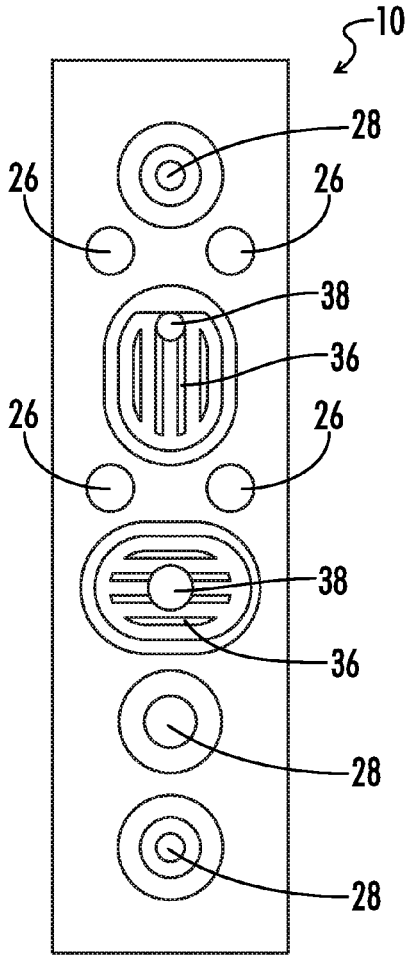
FIG. 20 is a proximal view of a filter plate of one embodiment of the present invention.
Figure 21:
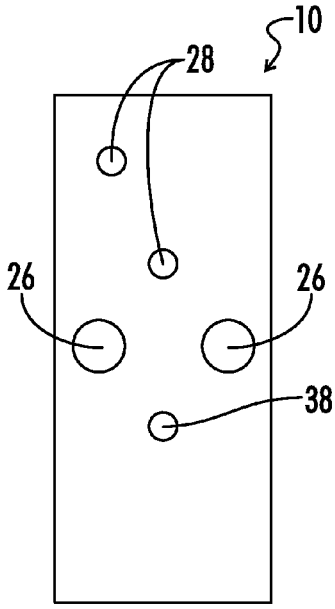
FIG. 21 is a distal view of a filter plate of one embodiment of the present invention.
Figure 22:
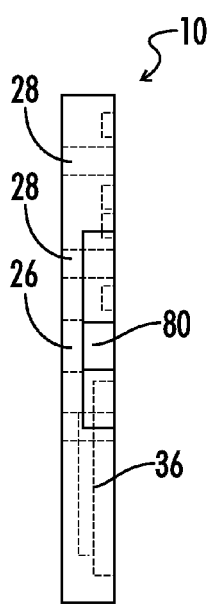
FIG. 22 is a side view of the filter plate of FIG. 21.
Figure 23:
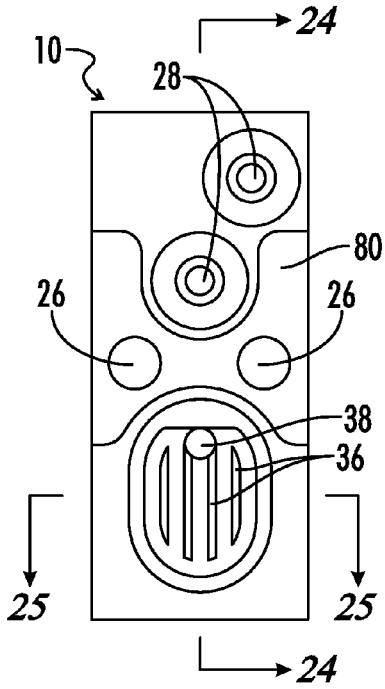
FIG. 23 is a proximal view of the filter plate of FIG. 21.
Figure 24:
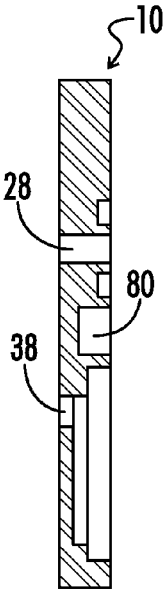
FIG. 24 is a sectional view of the filter plate of FIG. 23, taken along line 24-24 of FIG. 23.
Figure 25:
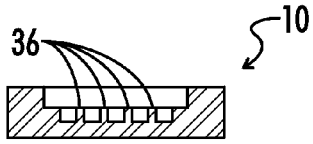
FIG. 25 is a sectional view of the filter plate of FIG. 23, taken along line 25-25 of FIG. 23.

Optionally, as illustrated in FIGS. 7 and 8, the filter plate 10 has a large cut-out 80. Optionally, as exemplified in FIG. 20, the filter plate 10 is configured to be used in conjunction with different valve assemblies 14 and heaters 12, in which case the filter plate 10 has several different adhesive apertures 38, fastener apertures 26, and air apertures 28 so that the same filter plate 10 may be used with different valve assemblies 14 and heaters 12.

An exemplary method of operation of the system 11 will now be described. A system 11 including a heater 12, a valve assembly 14 and one or more filter plates 10 is assembled, as described above. The adhesive temperature is maintained in the heater 12. The valve 17 is opened. The adhesive is delivered from the heater adhesive exit aperture 52, through the filter screen 40, through the filter plate adhesive exit aperture 38, through the valve assembly adhesive entrance aperture 24, into the valve assembly housing 15 and out of the valve assembly adhesive exit aperture 20. Preferably, if the valve 17 is opened by air, the method further includes delivering air from the heater to valve assembly air aperture 51, through the filter plate air aperture 28 and into the valve assembly air aperture 23 so as to open the valve 17. The skilled artisan will appreciate that the above method may be performed in any suitable order. For example, the valve 17 may be opened before, simultaneous with or after the adhesive is delivered from the heater adhesive exit aperture 52. Preferably, the filter plate 10 is configured to withstand temperatures between 250° F. and 450° F.

Figure 6:
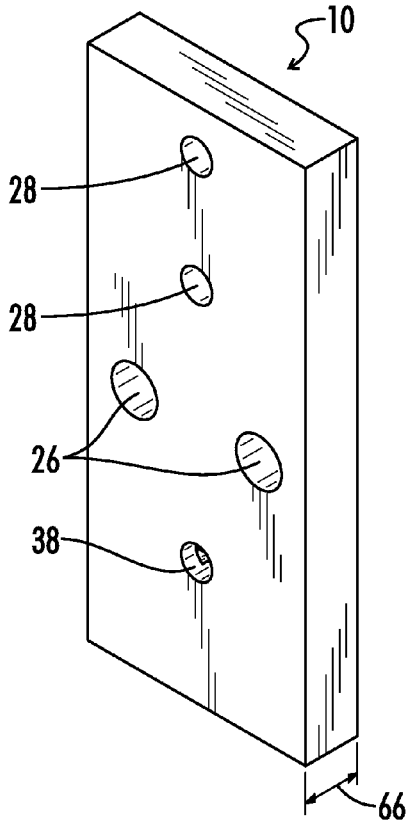
FIG. 6 is a distal view of the filter plate shown in FIG. 5.

Preferably, the system 11 is configured so as to minimize the loss of heat as the adhesive moves from the heater adhesive exit aperture 52 and into the valve assembly adhesive entrance aperture 24 so the adhesive maintains temperature. Preferably, the temperature of the adhesive drops no more than about 5° F. as the adhesive moves from the heater adhesive exit aperture 52 and ultimately out of the valve assembly adhesive exit aperture 20. For example, as shown in FIG. 6, the filter plate 10 has a thickness 66 that extends from the proximal surface 44 to the distal surface 46 and it is believed that a filter plate thickness 66 of from about 3 millimeters to about 7 millimeters (e.g., about 5 millimeters) will minimize heat loss. For example, it has been observed that having a filter plate thickness 66 of about 5 millimeters results in a temperature drop of less than 5° F. to the valve assembly adhesive exit aperture 20 if one filter plate 10 is used and a temperature drop of less than 8-10° F. if two filter plates 10 are used. The heater 12 temperature may be adjusted to compensate for this drop. Further, it is believed that assembling the system 11 such that the proximal surface 44 of the filter plate 10 contacts the valve assembly 14 or another filter plate 10 and the distal surface 46 contacts the heater 12 or another filter plate 10 will minimize heat loss.

Preferably, the components of the filter plate 10 are configured so as to facilitate the movement of the adhesive. For example, the adhesive exit aperture 38 may be located near the center of the wall 56 (as illustrated in FIGS. 5, 9, 10, 16, 17, 20, and 31-32) or near an edge of the wall 56 (as illustrated in FIGS. 7, 12-15 and 18-19, and 23-24). Further, the longitudinal axes 64 of the ribs 36 may be perpendicular to the longitudinal axis 62 of the valve assembly 14 (as illustrated in FIGS. 3, 5, 9, 10, 16, 17 and 30-32). Alternatively, the longitudinal axes 64 of the ribs 36 may be parallel to the longitudinal axis 62 of the valve assembly 14 (as illustrated in FIGS. 7, 12-15, 18-19, 23-25 and 30). Preferably, the valve assembly 14, filter plate 10, and filter screen 40 are comprised of aluminum, stainless steel and/or a metal alloy.

In designing the configuration of the ribs 36, it will be appreciated that a sufficient number of ribs 36 should be provided in order to maximize the surface area of the plate 10 that is exposed to the heated adhesive. However, it also will be appreciated that ribs 36 should not be placed so close together that the ribs 36 hinder the flow of the adhesive.

Preferably, if the system 11 includes two or more filter plates 10, the filter plates 10 have filter screens 40 with different sized apertures and the filter plate 10 with a filter screen 40 having larger apertures is located next to the heater 12 and the filter plate 10 with a filter screen 40 having smaller apertures (as compared to the other filter screen 40) is located next to the valve assembly 12 (and distal to the other filter plate 10) so that the adhesive flows through the filter screen 40 having larger apertures first.

Figure 33:
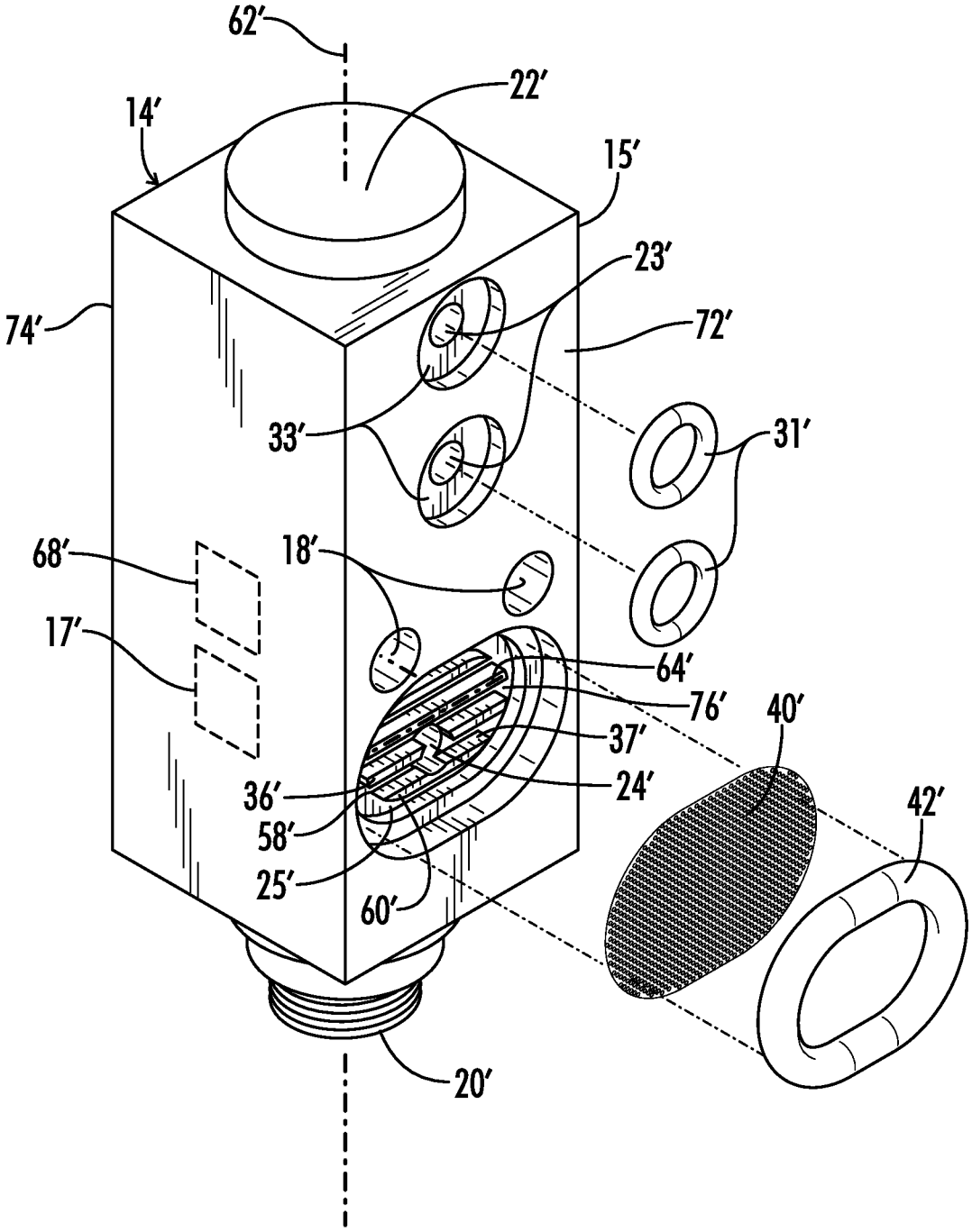
FIG. 33 illustrates a proximal, perspective view of a valve assembly of one embodiment of the present invention.

The Alternative Embodiment of FIG. 33

Instead of, or in addition to, having ribs and a filter screen located on a filter plate, as described above, the ribs and filter screen may be located in a recess in the housing of a valve assembly, as shown in FIG. 33. In this alternative embodiment, components having the same function and structure as components described above will be designated with the same numeral with an apostrophe after the numeral to indicate that the component corresponds to the embodiment of FIG. 33.

In the alternative embodiment, the system includes a heater having the same components and structure described with the prior embodiments and, optionally, a filter plate having the same components and structure described with the prior embodiments. The system further includes a valve assembly 14'. The valve assembly 14' has the same components and structure described with the prior embodiments (including but not limited to the housing 15', the valve assembly air apertures 23', the air recesses 33', the air aperture O-rings 31', the fastener apertures 18', the valve 17', the internal filter 68', the air vent aperture 22', the adhesive exit aperture or nozzle 20' and the longitudinal axis 62') except that the ribs 36' and filter screen 40' are located in the adhesive recess 25' of the valve assembly housing 15'. More particularly, the housing 15' includes a proximal surface 72' (which faces the heater and optionally a distal surface of a filter plate if a filter plate is also used), an opposite distal surface 74', and the adhesive recess 25' is located in the proximal surface 72'. The ribs 36', each have a base 58' attached to a wall 76' of the housing 15' forming the recess 25' (e.g., the distal-most wall of the recess 25') and an apex 60' extending proximally from the base 58'. The valve assembly adhesive entrance aperture 24' is located in a wall of the housing 15' forming the recess 25' (e.g., the distal-most wall of the recess 25'). A filter screen 40' is removably attached to the recess 25'. Optionally, the filter screen 40' is attached to the recess via an O-ring 42' that rest on the filter screen 40', as described in the prior embodiments.

The ribs 36' preferably perform three purposes: 1) physically supporting the filter screen 40'; 2) creating a grid 37' that helps direct the flow of the adhesive into the valve assembly adhesive entrance aperture 24'; and 3) increasing the surface area of the valve assembly housing 15' that the adhesive contacts so as to maintain heat of a larger area of adhesive as it moves from the heater adhesive exit aperture and into the valve assembly adhesive entrance aperture 24'.

Preferably, as with the prior embodiments, the system of FIG. 33 is configured so as to minimize the loss of heat as the adhesive moves from the heater adhesive exit aperture and into the valve assembly adhesive entrance aperture 24'. Preferably, the temperature of the valve assembly 14 does not drop when secured to the heater 12. For example, a filter plate is used in conjunction with the alternate embodiment, the filter plate preferably has a thickness of from about 3 millimeters to about 7 millimeters (e.g., about 5 millimeters). Further, it is believed that assembling the system such that the proximal surface 72' of the valve assembly 14' contacts the heater or a filter plate will minimize heat loss.

Preferably, the components of the valve assembly 14' are configured so as to facilitate the movement of the adhesive. For example, the valve assembly adhesive entrance aperture 24' may be located near the center of the wall 76' (as illustrated in FIG. 33) or near an edge of the wall 76'. Further, the longitudinal axes 64' of the ribs 36' may be perpendicular to the longitudinal axis 62' of the valve assembly 14' (as illustrated in FIG. 33). Alternatively, the longitudinal axes 64' of the ribs 36' may be parallel to the longitudinal axis 62' of the valve assembly 14'. Preferably, the valve assembly 14', filter plate (if used), and filter screen 40' are comprised of aluminum, stainless steel and/or a metal alloy.

For the purposes of the present disclosure, use of the singular encompasses use of the plural. For example, as previously indicated, the systems may include multiple filter plates and multiple screens, as indicated previously. In addition, other parts may be duplicated, depending on the needs of the operator. Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims.

What is claimed is:

1. An adhesive filtration system comprising:

a) a heater for heating an adhesive comprising a heater housing and an adhesive exit aperture located in the heater housing for dispensing an adhesive;

b) a valve assembly comprising a valve assembly heater housing, a valve assembly adhesive entrance aperture for allowing the adhesive to enter the valve assembly housing, a valve assembly adhesive exit aperture for allowing the adhesive to exit the valve assembly housing, and a valve, the valve having an open position in which the valve permits the adhesive to exit the valve assembly housing via the valve assembly adhesive exit aperture and a closed position in which the valve prevents the adhesive from exiting the valve assembly housing via the valve assembly adhesive exit aperture; and c) a filter plate positioned between the heater and the valve assembly, the filter plate comprising a proximal surface facing the heater housing, a distal surface facing the valve assembly housing, a filter plate adhesive recess extending from the proximal surface towards the distal surface, a filter plate adhesive exit aperture located in a wall of the filter plate forming the adhesive recess and extending through the distal surface, a filter plate thickness extending from the proximal surface to the distal surface, a rib comprising a rib base attached to a wall of the filter plate forming the adhesive recess and a rib apex extending proximally from the base, and a filter screen located in the adhesive recess, wherein said filter plate adhesive exit aperture has a proximal end located in said adhesive recess, a distal end located at said distal surface, and a length extending from said proximal end to said distal end; and further wherein said proximal end of said filter plate adhesive exit aperture is located adjacent to said rib base.

2. The adhesive filtration system of claim 1, wherein the filter plate comprises a plurality of ribs, and further wherein the filter screen is proximally disposed relative to the plurality of ribs.

3. The adhesive filtration system of claim 2, wherein the filter screen contacts the apexes of the ribs.

4. The adhesive filtration system of claim 1, wherein the filter plate proximal surface contacts the heater housing and the filter plate distal surface contacts the valve assembly housing.

5. The adhesive filtration system of claim 1, wherein the filter plate comprises a plurality of ribs, each rib comprising a rib base attached to a wall of the filter plate forming the adhesive recess and a rib apex extending proximally from the base, and the ribs form a grid for delivering the adhesive to the filter plate adhesive exit aperture and further wherein each rib apex points proximally toward said heater.

6. The adhesive filtration system of claim 5, wherein the plurality of ribs are generally straight.

7. The adhesive filtration system of claim 1, wherein the filter screen is removably attached to the filter plate via an O-ring.

8. The adhesive filtration system of claim 1, wherein the system comprises a plurality of filter plates.

9. The adhesive filtration system of claim 1, wherein the filter plate is configured for temperatures between 250° F. and 450° F.

10. The adhesive filtration system of claim 1, wherein the filter plate has a filter plate thickness extending from the proximal surface to the distal surface and the filter plate thickness is from about 3 to about 7 millimeters.

11. The adhesive filtration system of claim 1, wherein said heater heats said filter plate and said valve assembly.

12. A method of filtering an adhesive comprising, a) providing an adhesive filtration system comprising:

i) a heater for heating an adhesive comprising a heater housing and an adhesive exit aperture located in the heater housing for dispensing an adhesive;

ii) a valve assembly comprising a valve assembly housing, a valve assembly adhesive entrance aperture for allowing the adhesive to enter the valve assembly housing, a valve assembly adhesive exit aperture for allowing the adhesive to exit the valve assembly housing, and a valve, the valve having an open position in which the valve permits the adhesive to exit the valve assembly housing via the valve assembly adhesive exit aperture and a closed position in which the valve prevents the adhesive from exiting the valve assembly housing via the valve assembly adhesive exit aperture; and iii) a filter plate positioned between the heater and the valve assembly, the filter plate comprising a proximal surface facing the heater housing, a distal surface facing the valve assembly housing, a filter plate adhesive recess extending from the proximal surface towards the distal surface, a filter plate adhesive exit aperture located in a wall of the filter plate forming the adhesive recess and extending through the distal surface, a filter plate thickness extending from the proximal surface to the distal surface, a rib comprising a rib base attached to a wall of the filter plate forming the adhesive recess and a rib apex extending proximally from the base, and a filter screen located in the adhesive recess wherein said filter plate adhesive exit aperture has a proximal end located in said adhesive recess, a distal end located at said distal surface, and a length extending from said proximal end to said distal end; and further wherein said proximal end of said filter plate adhesive exit aperture is located adjacent to said rib base;

b) heating the adhesive in the heater to a temperature;

c) opening the valve; and d) flowing the adhesive from the heater adhesive exit aperture, through the filter screen, through the filter plate adhesive exit aperture, through the valve assembly adhesive entrance aperture, into the valve assembly housing and out of the valve assembly adhesive exit aperture.

13. The method of claim 12, wherein the temperature of the adhesive decreases not more than about 10° F. as the adhesive flows from the heater adhesive exit aperture to the valve assembly adhesive exit aperture.

14. A filter plate for filtering an adhesive-comprising:

a) a proximal surface configured to face a housing of a heater;

b) a distal surface configured to face a housing of a valve assembly;

c) a filter plate width;

d) a filter plate length;

e) a filter plate thickness extending from the proximal surface to the distal surface;

f) a filter plate adhesive recess extending from the proximal surface towards the distal surface;

g) a filter plate adhesive exit aperture located in a wall of the filter plate forming the adhesive recess and extending through the distal surface; and h) a plurality of generally straight ribs, the ribs each having a rib base attached to a wall of the filter plate forming the adhesive recess and a rib apex extending proximally from the base wherein said filter plate adhesive exit aperture has a proximal end located in said adhesive recess, a distal end located at said distal surface, and a length extending from said proximal end to said distal end;

and further wherein said proximal end of said filter plate adhesive exit aperture is located adjacent to a rib base.

15. The filter plate of claim 14, wherein the filter plate comprises a filter screen located in the adhesive recess.

16. The filter plate of claim 15, wherein the filter screen is proximally disposed relative to the plurality of generally straight ribs.

17. The filter plate of claim 10, wherein the filter plate further comprises a plurality of fastener apertures for removably attaching the filter plate between the heater and the valve assembly.

18. The filter plate of claim 10, wherein the filter plate has a filter plate thickness extending from the proximal surface to the distal surface and the filter plate thickness is from about 3 to about 7 mm.

19. The filter plate of claim 10, wherein the filter plate further comprises an air aperture so that air may be delivered from the heater housing to the valve assembly housing and further wherein the filter plate further comprises an O-ring encircling the air aperture.

20. The filter plate of claim 10, wherein the filter plate is configured for temperatures between 250° F. and 450° F.

21. The filter plate of claim 10, wherein the plurality of ribs each have a longitudinal axis parallel to one of the filter plate width and the filter plate length.

22. The filter plate of claim 14 wherein each rib apex points in the proximal direction.

23. An adhesive filtration system comprising:

a) a heater configured to heat an adhesive to a temperature of from about 250° F. to about 450° F., the heater comprising a heater housing and an adhesive exit aperture located in the heater housing for dispensing an adhesive;

b) a valve assembly housing having a proximal surface comprising a recess and a distal surface, the recess extending from the proximal surface towards said distal surface;

c) a valve assembly adhesive entrance aperture located in a wall of the valve assembly forming the recess for allowing the adhesive to enter the housing;

d) a plurality of ribs, the ribs each having a rib base attached to a wall of the valve assembly housing forming the recess and a rib apex extending proximally from the base;

e) a valve assembly adhesive exit aperture for allowing the adhesive to exit the valve assembly housing; and f) a valve having an open position in which the valve permits the adhesive to exit the valve assembly housing via the valve assembly adhesive exit aperture and a closed position in which the valve prevents the adhesive from exiting the valve assembly housing via the valve assembly adhesive exit aperture, wherein said proximal end of said valve assembly entrance aperture is located adjacent to a rib base.

24. The adhesive filtration system of claim 23, wherein the filter plate comprises a filter screen located in the recess.

25. The adhesive filtration system of claim 24, wherein the filter screen is proximally disposed relative to the plurality of ribs.

26. The adhesive filtration system of claim 23, wherein the plurality of ribs are generally straight.

27. A method of filtering an adhesive comprising, a) providing an adhesive filtration system comprising:

i) a heater for heating an adhesive, the heater comprising a heater housing and an adhesive exit aperture located in the heater housing for dispensing an adhesive;

ii) a valve assembly housing having a proximal surface comprising a recess and a distal surface, the recess extending from the proximal surface towards said distal surface;

iii) a valve assembly adhesive entrance aperture located in a wall of the valve assembly forming the recess for allowing the adhesive to enter the valve assembly housing, the valve assembly entrance aperture having a proximal end located in said recess, a distal end located in said valve assembly housing, and a length extending from said proximal end to said distal end;

iv) a plurality of ribs, the ribs each having a rib base attached to a wall of the valve assembly housing forming the recess and a rib apex extending proximally from the base;

v) a valve assembly adhesive exit aperture for allowing the adhesive to exit the valve assembly housing; and vi) a valve having an open position in which the valve permits the adhesive to exit the valve assembly housing via the valve assembly adhesive exit aperture and a closed position in which the valve prevents the adhesive from exiting the valve assembly housing via the valve assembly adhesive exit aperture wherein said proximal end of said valve assembly entrance aperture is located adjacent to a rib base;

b) heating the adhesive in the heater;

c) opening the valve; and d) flowing the adhesive from the heater adhesive exit aperture, through a filter screen, through the valve assembly adhesive entrance aperture, into the valve assembly housing and out of the valve assembly adhesive exit aperture.

* * * * *